US012583708B2

(12) United States Patent
Carrio Mocho

(10) Patent No.: US 12,583,708 B2
(45) Date of Patent: Mar. 24, 2026

(54) DEVICE FOR DEPLOYING ROLL-UP REELS

(71) Applicant: BRICO-COLOR, S.L., Benissa (ES)

(72) Inventor: Miguel Carrio Mocho, Benissa (ES)

(73) Assignee: BRICO-COLOR, S.L., Benissa (ES)

( * ) Notice: Subject to any disclaimer, the term of this patent is extended or adjusted under 35 U.S.C. 154(b) by 128 days.

(21) Appl. No.: 18/282,720

(22) PCT Filed: Mar. 17, 2022

(86) PCT No.: PCT/ES2022/070153

§ 371 (c)(1),
(2) Date: Sep. 18, 2023

(87) PCT Pub. No.: WO2022/195150

PCT Pub. Date: Sep. 22, 2022

(65) Prior Publication Data

US 2024/0158200 A1 May 16, 2024

(30) Foreign Application Priority Data

Mar. 18, 2021 (ES) ..... 202130239

(51) Int. Cl.
*B65H 75/44* (2006.01)

(52) U.S. Cl.
CPC ..... *B65H 75/4465* (2013.01)

(58) Field of Classification Search
CPC ..... B65H 75/44; B65H 75/4402; B65H 75/4457; B65H 75/4465; B65H 49/32; B65H 49/321
See application file for complete search history.

(56) References Cited

U.S. PATENT DOCUMENTS

| | | | | |
|---|---|---|---|---|
| 2,155,773 A | | 4/1939 | Porter | |
| 3,304,060 A | | 2/1967 | Wanless et al. | |
| 3,833,997 A | * | 9/1974 | Kaddatz | B65H 49/32 254/131 |
| 4,705,283 A | | 11/1987 | Kleisath | |
| 5,109,882 A | * | 5/1992 | Eley | B65H 75/4478 137/355.27 |
| 5,179,972 A | * | 1/1993 | Eley | B65H 75/4478 137/355.19 |
| 5,316,232 A | | 5/1994 | Lambert | |
| 5,330,121 A | * | 7/1994 | Eley | B65H 75/403 242/399.2 |

(Continued)

FOREIGN PATENT DOCUMENTS

| | | | |
|---|---|---|---|
| FR | 2894236 | A1 | 4/2009 |
| WO | 2022195150 | A1 | 9/2022 |

OTHER PUBLICATIONS

International Search Report and Written Opinion for PCT/ES2022/070153 issued on May 12, 2022.

*Primary Examiner* — Sang K Kim
(74) *Attorney, Agent, or Firm* — Kutak Rock LLP

(57) ABSTRACT

Device (7) for deploying cable reels, irrigation hoses, ropes or the like such as elongated and flexible elements which are wound and unwound around a reel (7) for storage, use and transport and which basically consist of a support base (13) and at least one support means of the reel (7) and extensible linking means consisting of a plurality of inner tubes (2) connected to a plurality of outer tubes (1) through at least one anchoring system (5) and at least one tilting and anchoring mechanism (6).

15 Claims, 5 Drawing Sheets

(56) References Cited

U.S. PATENT DOCUMENTS

| | | | | |
|---|---|---|---|---|
| 6,908,058 | B2 | 6/2005 | Moon et al. | |
| 8,727,361 | B2 * | 5/2014 | Jordan | B62B 1/20 242/596.4 |
| 9,187,289 | B1 * | 11/2015 | Jordan | B65H 75/02 |
| 9,409,744 | B2 * | 8/2016 | Jordan | B65H 75/02 |
| 10,272,935 | B1 * | 4/2019 | Jordan | B65H 49/325 |
| 2006/0138270 | A1 | 6/2006 | Lichtscheidl et al. | |
| 2009/0038864 | A1 | 2/2009 | Yun | |

* cited by examiner

DEVICE FOR DEPLOYING ROLL-UP REELS

This is the United States National Stage of Patent Cooperation Treaty Application No. PCT/ES2022/070153, filed Mar. 17, 2022, which claims priority to Spanish Application No. P202130239, filed Mar. 18, 2021, the disclosures of which are incorporated herein by reference in their entireties.

OBJECT OF THE INVENTION

The invention, as expressed in the wording of the present specification, relates to a device for deploying cable reels, irrigation hoses, ropes or the like as elongated, flexible elements which are wound and unwound around a reel for storage, use and transport.

BACKGROUND TO THE INVENTION

In the field of winding reels, also commonly known as extension reels or extension reels when the element to be wound is an electric cable, there are different configurations for their support structure.

The most widely used extensions are those of the type comprising a support structure consisting of a single folded tube which constitutes both the means of support for the reel and the handle for its transport. In this configuration the reel is practically level with the support surface on which it rests, which is normally the floor.

For this reason, the use of this type of extension pole is uncomfortable and cumbersome for the user, who, if he cannot find a raised surface on which to rest the extension pole, has to wind and unwind the cable in a crouched position.

In construction sites, warehouses, workshops or other types of establishments where the use of extension cables is widespread, there are usually no raised surfaces to support the reel, thus forcing the operator to wind the cable in a bent position unfavourable to the back, which not only puts his health and safety at risk, but also makes it difficult to wind the cable manually, increasing the operating time.

Technical experts are aware of the difficulty of winding and unwinding cables, as the cable often unwinds faster and the cable often slips off the reel. To avoid this, it is necessary for the user to guide the cable by hand, which is even more difficult to do when the user is in a bent position.

In the state of the art there are some solutions to this problem, which provide the reel with a certain elevation through different support structures, which bring the following advantages of safety, stability, balance and comfort for the user.

U.S. Pat. No. 6,908,058 relates to a trolley for hose storage reels comprising a remote reel handle mounted on top of the handle to allow rotation of the reel from an elevated position. As can be seen in the figures, the trolley or support structure provides a certain height for the remote crank that operates the cable rewind, so that it is conveniently accessible to the user, while the reel remains at a lower height. This distance between the crank and the reel results in a complex structure and a multitude of additional elements for its connection, which increases its cost, its size and makes it difficult to store and transport.

On the other hand, document US20060138270 presents a portable cable station comprising a handlebar configured to move between an extended and a retracted position. This system in its extended position allows for convenient transport of the reel while in its retracted position it reduces the space occupied by the support structure. However, it does not provide height to the rewind reel, so that cable rewinding is performed from a position that is uncomfortable for the user.

Finally, French patent FR2894236 relates to a system allowing the use and storage of a garden hose. It features a variable geometry that allows two positions of use of the system, at different heights, thanks to a mobile section that can pivot in relation to the ground support and lock with a ratchet mechanism (5*a*, 5*b*) and handwheel (6*a*, 6*b*) with the hose reel in upper or lower positions. In this case, although the reel is raised to a certain height, providing stability and comfort to the system, the tilting means allow only two positions of the reel, this solution not being adaptable to different users and different heights. Furthermore, as in the previous case, the structure includes a multitude of tubes that make it more expensive and would take up even more space if the reel were to be raised to a height of 80 or 90 cm from the ground, where the handling of the cable is more comfortable for the operator.

In view of the above, there is still room for improvement of reel reel support structures of the type that raise the reel to a certain height.

DESCRIPTION OF THE INVENTION

The deployment device for winding reels of the present invention solves the problems of the prior art as it provides a deployable support means that raises the reel of reels to different adjustable heights, thus adapting to each user, all without compromising the size or complexity of the assembly and without increasing its cost.

In addition, a device is achieved that not only adds height to the reel with the advantages of safety, stability, balance and comfort that this entails, but it is also retractable, thus reducing its size for easy storage and transport.

For this purpose, the deployment device for winding reels of the present invention comprises:

- Means that constitute the support base of the deployment device;
- Support means of the reel; and
- Extensible linking means between the means of support which are constituted with the support base and the means of support of the reel.

It is clarified that, in the text of this specification, the term 'spool' refers to the curved (usually cylindrical) surface around which the elongated flexible element is wound and unwound, whereas the term 'Winding' refers either to the elongated flexible element itself when in a wound configuration or to the action of winding.

The extensible linking means between the support base and the reel make it possible, in an extended or partially extended position, to raise the reel to different heights in an adjustable manner and, in a retracted position, to reduce the size of the deployment device.

DESCRIPTION OF THE DRAWINGS

In order to complement the description being made and in order to assist in a better understanding of the features of the invention, in accordance with a preferred example of a practical embodiment thereof, a set of drawings is attached hereto as an integral part of the said description, in which the following is illustratively and non-limitingly depicted.

PREFERRED EMBODIMENT OF THE INVENTION

A detailed explanation of an example of a preferred embodiment of the subject matter of the present invention is given below with the aid of the figures referred to above.

In a first preferred embodiment of the present invention the extensible linking means are constituted with at least one outer tube (1) and at least one inner tube (2) of smaller cross-section than the outer tube (1), configured in such a way as to allow relative movement between them.

More specifically, the inner tube (2) can move inside the outer tube (1) in its axial or longitudinal direction, i.e. the inner tube (2) can be pushed in or pulled out of the outer tube (1).

In the following text, when the inner tube (2) is inserted into the outer tube (1) it will be referred to as a retraction, whereas when the inner tube (2) is withdrawn from the outer tube (1) it will be referred to as an extension.

Figure 1:
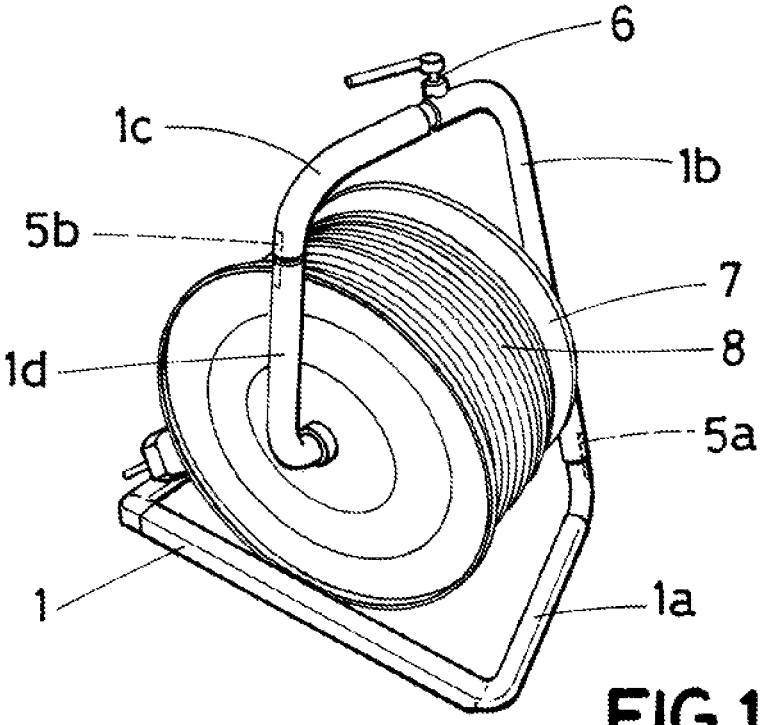
FIG. 1.— Shows a first embodiment of the deployment device for winding reels comprising a series of outer and inner tubes, seen in perspective when the device is in its retracted position.
Figure 2:
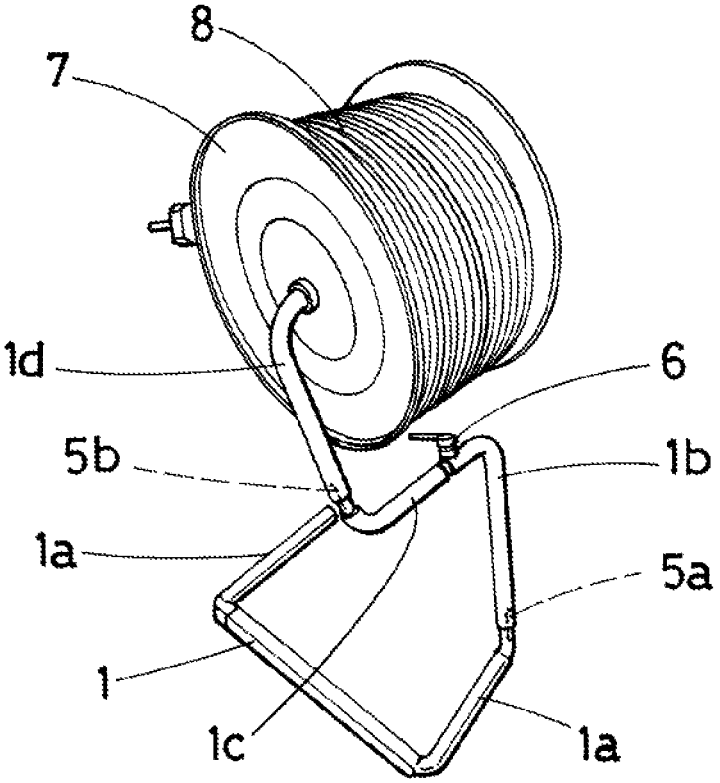
FIG. 2.— Shows the deployment device for winding reels of FIG. 1 when in a partially retracted position, prior to the tilting of the reel.

When the deployment device is in its retracted position, the length comprising the inner tube (2) is inserted completely inside the outer tube (1), not being visible from the outside, as in FIGS. 1 and 2.

In an extended position of the deployment device, the inner tube (2) is at least partially outside the outer tube (1), so that the length of inner tube (2) outside the outer tube (1) is proportional to the elevation of the reel (7).

In this way, it is possible to adjust the height at which the reel (7) is positioned in relation to the means that are constituted with the support base (13) of the deployment device.

In the configuration shown in FIGS. 1 to 4, the linking means comprise a plurality of outer tubes (1), at least one of which has a curvature that allows the geometry of the device to be modified. The inner tubes (2) are straight.

The final configuration of the deployment device is achieved by inserting the first end of a first inner tube (2) into an end of a first outer tube (1), and the second end of the first inner tube (2) into an end of a second outer tube (1).

Figure 3:
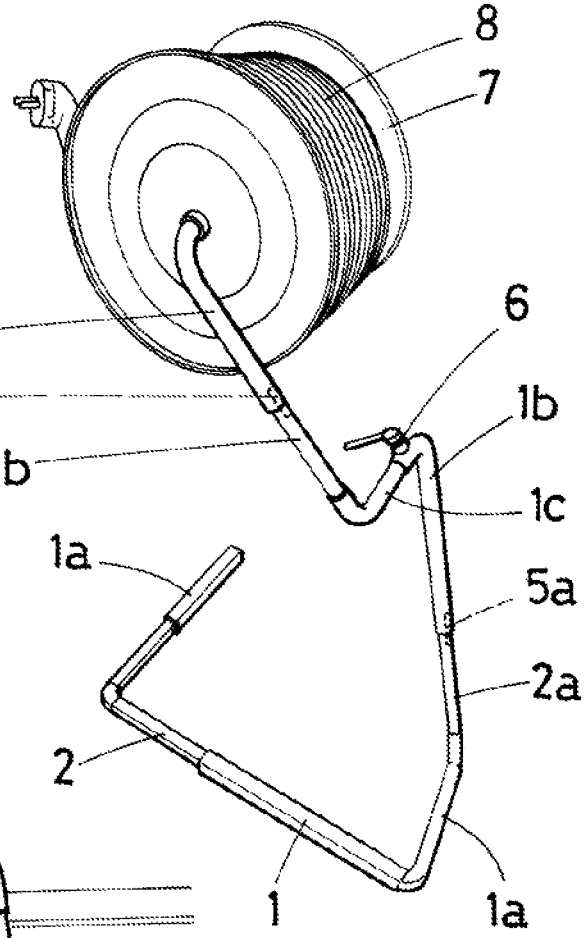
FIG. 3.— Shows the deployment device for winding reels of FIG. 1 when in a fully extended position.

Thus, when the deployment device is in its retracted position, the outer tubes (1) are positioned next to each other as in FIG. 1 or 2, whereas when the deployment device is in its extended position, two outer tubes (1) which in retracted position were contiguous are now separated by an inner tube (2) as in FIG. 3.

The geometry adopted by the outer tubes (1) that make up the deployment device must be such as to provide the necessary stability to the assembly when it is in its extended position (FIG. 3), as well as to take up as little space as possible when it is in its retracted position (FIG. 1).

The means constituting the support base of the deployment device can be configured with an outer tube (1) comprising two curved sections or folds so that its geometry presents two parallel and opposite sides (la) joined together by a third side, as can be seen in more detail in FIG. 2.

This outer tube (1), which forms the support base of the deployment device, can be further subdivided into several sections of outer tubes (1) containing inside them extensible inner tubes (2) that allow to increase their length, as shown in FIG. 3.

The outer tube (1) that forms the support base of the deployment device has a free end, while attached to its other end there is a succession of outer tubes (1), also folded, which house the corresponding inner tubes (2), so that together they form the extensible linking means between the support base (13) and the support means of the reel (7).

The geometry of the outer tubes (2) must be such as to provide the deployment device with the necessary rigidity so that the operation of the winding (8), normally operated by means of a hand crank (9), does not destabilise the system.

More specifically, it is desirable that a first outer tube (1*d*) adjacent to the support means of the reel (7) is arranged inclined with a vertical component, thus preventing the forces transmitted to the reel (7) by the user when winding and unwinding the winding (8) from creating moments of force that destabilise the deployment device.

In normal use of the deployment device and reel (7) assembly, it is also advisable for the user to keep the support base (13) stationary, for example by stepping on it with one foot, while winding or unwinding the cable to prevent unwanted movement of the assembly.

On the other hand, the deployment device may comprise an anchoring system (5) as a connecting system between an inner tube (2) and an outer tube (1), which allows the axial position of the inner tube (2) within the outer tube (1) to be adjusted.

In one of its positions, the anchoring system (5) prevents axial displacement of the inner tube (2) within the outer tube (1), while in another position it allows such displacement.

In other words, the anchoring system (5) is capable of fixing the axial position of the inner tube (2) within the outer tube (1).

Figure 5A:
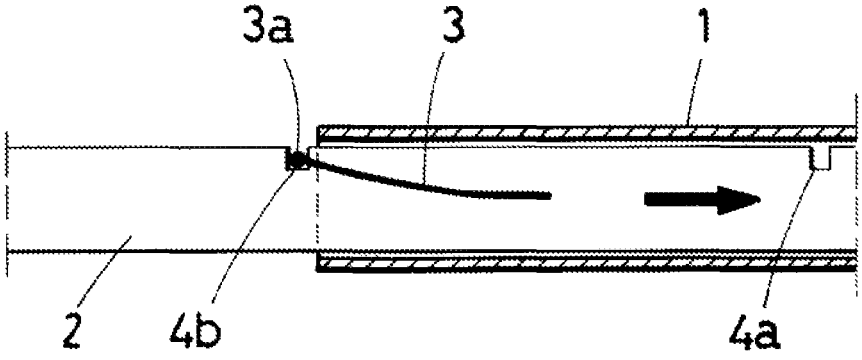
FIGS. 5*a* and 5*b*.— Show a detail of the anchoring system joining an outer tube to an inner tube, when the axial movement of the inner tube inside the outer tube is blocked and allowed, respectively.
Figure 5B:
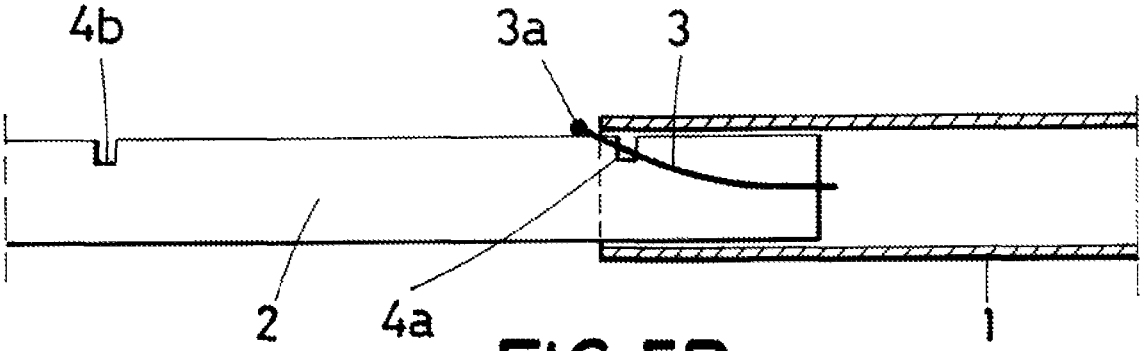

In one possible embodiment, the anchoring system (5) comprises the following elements according to FIGS. 5*a* and 5*b*:

- A strap (3), anchored to one end of the outer tube (1), comprising a protrusion (3*a*) at its end;
- At least one extended tube locking recess (4*a*) in the inner tube (2) which marks the end position of the extended tube in its extended position.
- At least one retracted tube locking recess (4*b*) in the inner tube (2) which marks the end position of the retracted tube in its retracted position.

The distance between the recess (4*a*, 4*b*) is the maximum length of inner tube (2) that can be safely and securely anchored outside the outer tube (1).

If it is desired for an inner tube (2) to have an adjustable extension (to achieve an adjustable height of the reel (7)), a plurality of extended tube locking recess (4*a*) can be provided along the surface of the inner tube (2).

The operation of the anchoring system (5) is described below.

During the extension and retraction movement of the inner tube (2) inside the outer tube (1), the strap (3) is free and tension-free protruding from one end of the outer tube (2) (see FIG. 5*b*). As the inner tube (2) advances or retracts, the strap (3) slides along the outer surface of the inner tube (2) unopposed.

When the inner tube (2) reaches the final extended position in which its advance is to be blocked, the protrusion (3*a*) of the strap (3) is inserted into the extended tube locking recess (4*a*), thus anchoring it and preventing further advance of the inner tube (2). In this position, the strap (3) is tensioned.

When the inner tube (2) is describing a movement indicated by an arrow in FIG. 5*a* and reaches the final retracted position in which its retraction is to be locked, the protrusion (3*a*) of the strap (3) is inserted into the retracted tube locking recess (4*b*), thus anchoring it and preventing further retraction of the inner tube (2).

Finally, to release the strap (3) from the recess (4*a*, 4*b*) and to resume the forward or backward movement of the inner tube (2), its protrusion (3*a*) is pulled free while the inner tube (2) is pushed slightly into the outer tube (1) to release the tension of the strap (3).

However, the anchoring system (5) is not limited to the one described above, but it is possible to use another system that achieves the desired effect of locking the extension or retraction of an inner tube (2) inside an outer tube (1) in an adjustable manner.

For example, the anchoring system (5) may comprise a plurality of retractable bosses arranged on the side surface of the inner tube (2) capable of being inserted into a plurality of holes of the same shape formed in the outer tube (1), thus anchoring the assembly.

On the other hand, there is a second type of connection between an outer tube (1) and an inner tube (2), consisting of a tilting and anchoring mechanism (6). This mechanism allows not only to regulate the advance or retreat of the inner tube (2) inside the outer tube (1) in longitudinal direction, but also to regulate the rotation of the inner tube (2) around an axis defined by its longitudinal direction.

In other words, the tilting and anchoring mechanism (6) is capable of fixing the angular and axial position of the inner tube (2) within the outer tube (1).

The rotation allows the set of tubes (1, 2) attached to one end of the rotating inner tube (2) to tilt relative to the outer tube (1) which houses the inner tube (2), ultimately allowing the deployment device to be more compact and occupy less space in its retracted arrangement.

Figure 6:
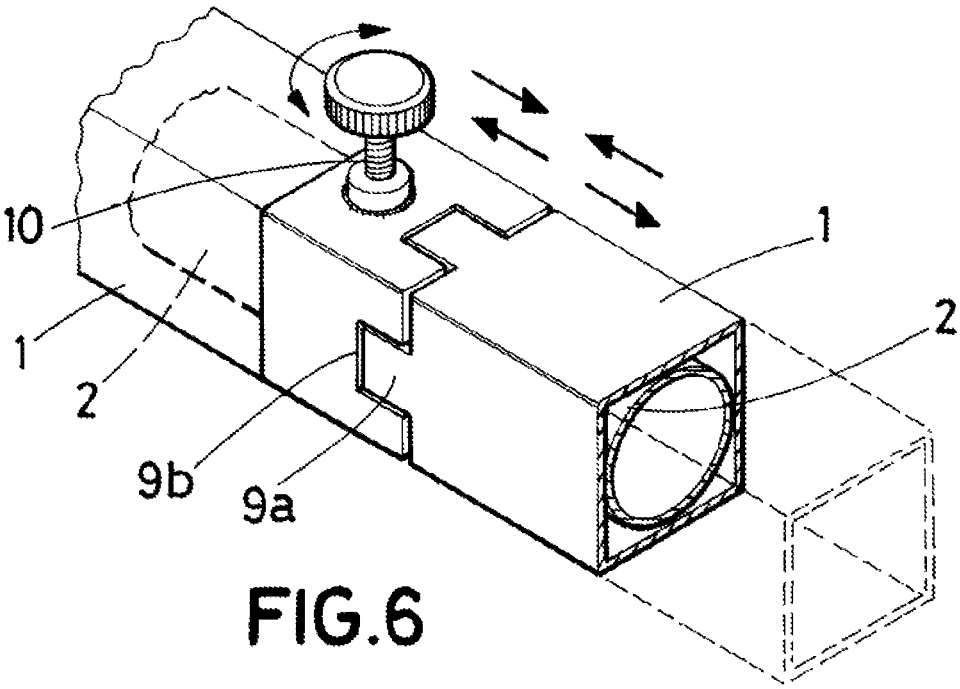
FIG. 6.— A detail of the tilting and anchoring mechanism is shown.

A possible embodiment of the tilting and anchoring mechanism (6), shown in FIG. 6, may comprise:

- a clamping screw (10) that passes through the side surface of the outer tube (1) without passing through the inner tube (2); and
- a male clamp (9*a*) and a female clamp (9*b*) made at the ends of two outer tubes (1), respectively, inside which runs the same inner tube (2).

In its tightened position, the free end of the clamping screw (10) presses against the side surface of the inner tube (2), thus fixing its axial position inside the outer tube (1) and preventing it from moving longitudinally.

Likewise, by fitting, the female clamp (9*b*) into the male clamp (9*a*), fixes the angular position of an outer tube (1) with respect to another outer tube (1), preventing it from rotating.

On the other hand, when the clamping screw (10) is loosened, the inner tube (2) is released and is free to move in the longitudinal direction.

Likewise, when the female clamp (9*b*) is uncoupled from the male clamp (9*a*), both the inner tube (2) and the outer tube (1) are free to rotate with respect to the other outer tube (1).

In another preferred embodiment, the tilting and anchoring mechanism (6) may comprise, instead of a clamping screw (10), a pin that diametrically crosses both the side surfaces of the outer tube (1) and the inner tube (2).

A third type of joint between an outer tube (1) and an inner tube (2) is the end-welded joint.

In the preferred embodiment shown in FIG. 3, the deployment device comprises a single joint based on the tilting and anchoring mechanism (6), while the remaining joints are made either by means of anchoring systems (5*a*, 5*b*), which do not allow relative rotation between tubes, or by means of welded joints. However, the present invention is not limited to this configuration.

The sequence of steps to be followed to bring the deployment device from an extended to a retracted position is explained below.

FIG. 3 refers to the deployment device in its fully extended position, for which the reel (7) reaches a higher elevation. Starting from this configuration, a first anchoring system (5*b*) is loosened so that a first inner tube (2*b*) is inserted inside a first outer tube (1*d*), this is the deployment device is retracted and the reel (7) reduces its height with respect to the support base (13).

A second anchoring system (5*a*) is then loosened so that a second inner tube (2*a*) is inserted into a second outer tube (1*b*). The inner tubes (2) forming the support base are also retracted.

The configuration of the deployment device at this point can be seen in FIG. 2, where the reel (7) still has some elevation.

To achieve a more compact final configuration, as shown in FIG. 1, the tilting and anchoring mechanism (6) is loosened and a second outer tube (1*c*) is rotated relative to a third outer tube (1*b*). In this way, the reel (7) tilts relative to the second outer tube (1*c*) until it occupies a position that is not elevated relative to the support base of the deployment device, as shown in FIG. 1.

The sequence of steps to be followed to bring the deployment device from a retracted to an extended position would be the reverse of that described above.

Since the different outer tubes (1) and inner tubes (2) that make up the deployment device are independent and separable from each other, it is possible to separate, for example, the following set of tubes from the rest of the deployment device: the first outer tube (1*d*) which is attached to the reel (7), a first inner tube (2*b*), the second outer tube (1*c*) and a third inner tube (2*c*).

Figure 4:
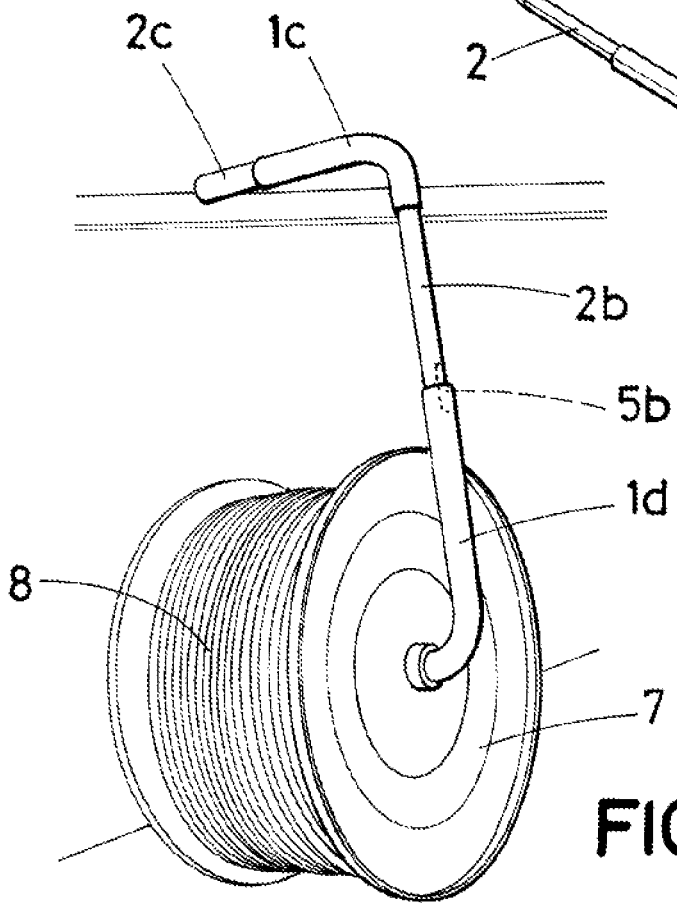
FIG. 4.— Shows the deployment device for winding reels of FIG. 1 hanging from a surface comprising an overhang.

This provides a support structure of the reel (7) that can be suspended from surfaces comprising an overhang, such as window frames or scaffolding, via the third inner tube (2*c*) as shown in FIG. 4.

This functionality is very useful for an operator working on different types of surfaces as it is not necessary to unwind as much cable, but the extension pole itself can be brought close to any difficult to access operating surface that is elevated.

In view of the above, the device described here has low manufacturing costs, as it is assembled in a simple way and using a small number of components.

In addition, the inner tubes (2) and outer tubes (1) can be disassembled, which even makes it possible to store the different elements separately and then assemble them.

Figure 7:
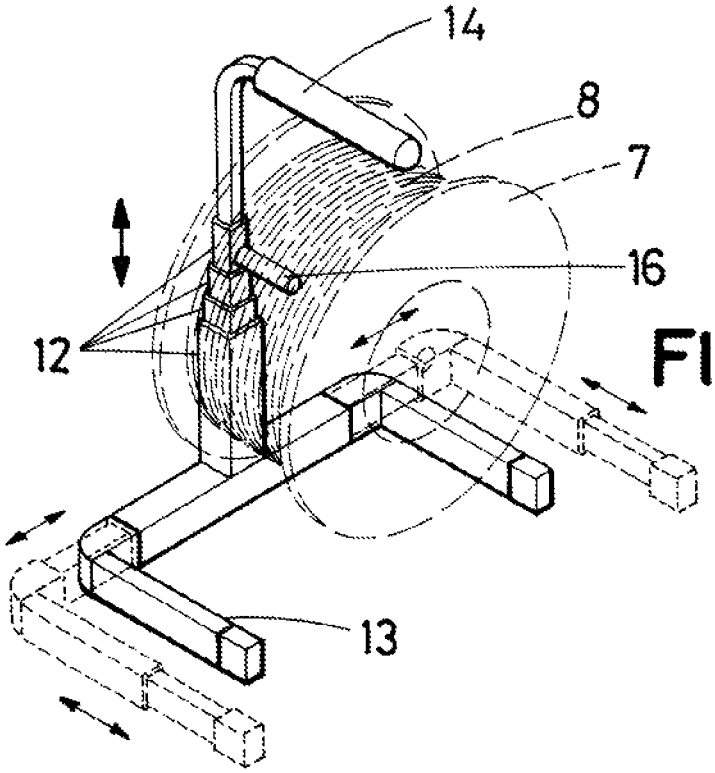
FIG. 7.— Shows a second embodiment of the reel reel deployment device comprising telescopic members.

In a second preferred embodiment of the present invention, shown in FIG. 7, the extensible linking means are constituted with telescopic members (12).

The telescopic members (12) may comprise a plurality of tubes of variable cross-section mounted within each other in an axially sliding manner, so that the inner tubes can be pulled out or pushed into the outer tubes in a controlled manner.

The telescopic members (12) comprise locking means that allow, as an inner tube extends out of an outer tube, to anchor the position of the inner tube within the outer tube at different heights.

This enables both extension and retraction of the telescopic members (12) in an adjustable manner and with different anchoring positions, which raise the reel (7) to different heights.

The deployment device further comprises a support base (13), which can be stepped on by the user when extending the telescopic members (12) to ensure the stability of the assembly.

On the other hand, the support means of the reel (7) may comprise a support element (16) attached to the inner tube defining the upper end of the telescopic members (12).

Furthermore, the deployment device comprises a folded tube with one of its sides arranged parallel to the support base (13) which acts as a handle (14) to pull to extend the telescopic members (12).

In a third preferred embodiment of the present invention the extensible linking means are constituted with a accordion-type deployable structure (15).

Figure 8A:
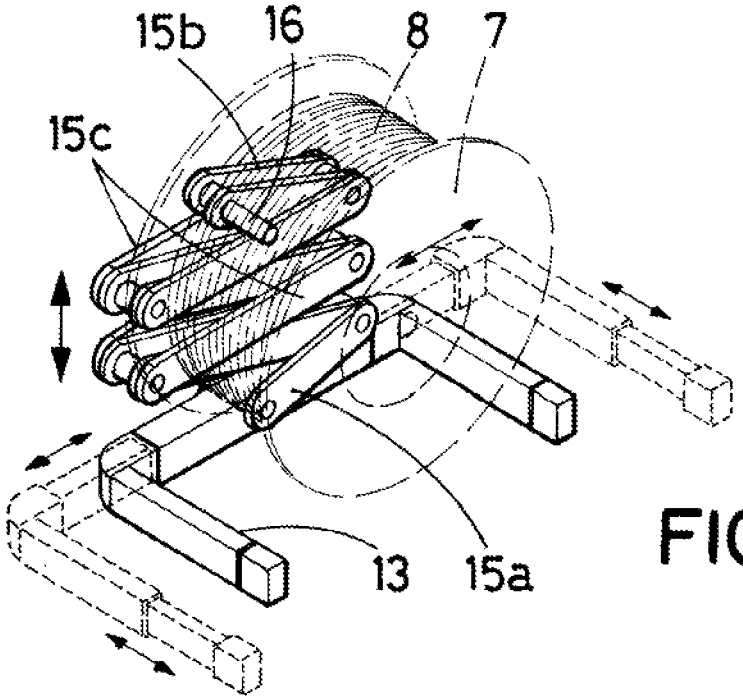
FIGS. 8*a* and 8*b*.— Show a third and fourth embodiment of the deployment device for winding reels comprising a single and double accordion-type deployable structure, respectively.
Figure 8B:
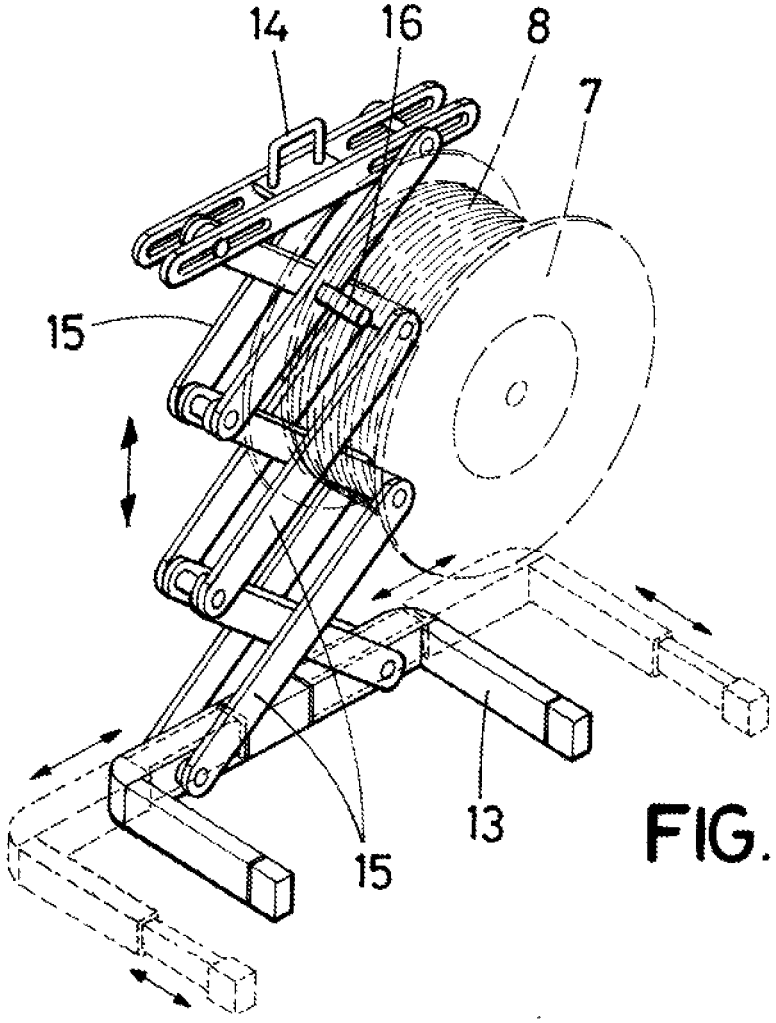

In FIG. 8*a*, the deployable structure (15) comprises a single type accordion, while in FIG. 8*b*, the deployable structure (15) comprises a double type accordion.

In both cases, the deployment device comprises a support base (13) that can be stepped on by the user when extending the deployable structure (15) to ensure the stability of the assembly, one of the ends of the deployable structure (15) constituting the connection to the support base (13), and another of its ends constituting the support means of the reel (7).

In the case of the simple accordion, it is desirable that the initial elongation (15*a*) and the final elongation (15*b*) of the accordion comprise a length substantially equal to half the length of the intermediate elongations (15*c*), so that when the deployable structure (15) is fully deployed, the reel (7) is substantially centred with the support base (13).

For any of the three preferred embodiments presented, the following additional elements, not shown in the figures, are envisaged, which would provide an advantage in the use of the deployment device.

Firstly, it is considered the use of rolling means in the support base (13) that facilitate the transport of the deployment device of the present invention, especially in its deployed or extended position where handling is more laborious. In this way the reel (7) is brought closer to the user, avoiding having to unwind a greater length of cable.

On the other hand, a possible embodiment of the invention is one in which the support base (13) comprises two telescopic sections that improve the stability of the assembly by covering a larger support surface. This will be particularly useful in cases where the winding (8), either because of its length or the material used in its manufacture, has a high weight. Thus, it will be of even greater interest in cases such as those described above and shown in FIGS. 8*a* and 8*b*, since the greater the height, the more the stability of the assembly will be compromised.

Figure 9:
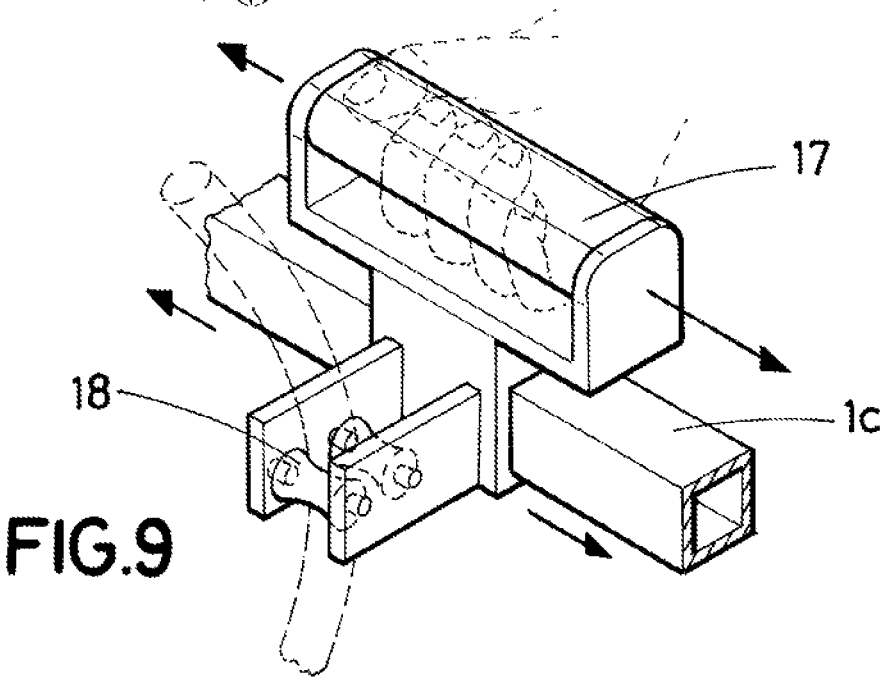
FIG. 9.— Shows a perspective view of a detail of a possible embodiment of the invention in which a grip handle is included.

Another possible embodiment of the invention is one in which the device incorporates a grip handle (17), for example as shown in the detail shown in FIG. 9, which is capable of being slidably attached to either of the outer tubes (1), although in the example shown in the figure it is attached to the second outer tube (1*c*).

The grip handle (17), as can be seen in FIG. 9, also includes a cable guiding mechanism (18) which, according to the example shown, consists of bearings made of a plastic material such as nylon or similar, which help the cable to run easily without twisting.

It is also considered the possibility of operating the rotary movement of the reel (7), which causes the winding or unwinding of the flexible and elongated element, either manually, by means of a hand crank, for example, or automatically, by means of a motor, for example.

In this last realisation it is also possible to control the motor through a remote control, which could also drive the rotation of the rolling means of transport to obtain a fully automated deployment device and reel (7) assembly, providing a more comfortable experience for the user.

Finally, a guiding system for the elongated flexible element is considered. This is a system that guides the flexible element during winding, so that the flexible element is evenly distributed over the entire surface of the reel (7) and does not pile up on one side or the other of the reel.

For example, the guiding system may consist of a worm screw through which an elongated flexible element carrier medium is moved axially and which moves forwards or backwards in its movement when the reel (7) is rotated in either direction, while the worm remains static.

In view of this description and the set of figures, the person skilled in the art will understand that the embodiments of the invention that have been described can be combined in multiple ways within the subject matter of the invention. The invention has been described according to some preferred embodiments thereof, but it will be apparent to the person skilled in the art that multiple variations can be introduced into such preferred embodiments without exceeding the claimed subject matter of the invention.

The invention claimed is:

1. A deployment device for winding reels (7), comprising at least:

a support base (13);

a support means of the reel (7);

extensible linking means between the support base (13) of the deployment device and the support means of the reel (7), comprising at least one axially displaceable inner tube (2) within at least one outer tube (1); and an anchoring system (5) capable of fixing the axial position of the inner tube (2) within the outer tube (1);

the device being characterised in that the anchoring system (5) comprises a strap (3) capable of being inserted into at least one extended tube locking recess (4*a*) and at least one retracted tube locking recess (4*b*) made in the inner tube (2).

2. The deployment device according to claim 1, characterised in that the extensible linking means comprise at least one inner tube (2) with freedom of rotation inside at least one outer tube (1).

3. The deployment device according to claim 2, characterised in that it comprises a tilting and anchoring mechanism (6) capable of fixing the angular and axial position of the inner tube (2) inside the outer tube (1).

4. The deployment device according to claim 3, characterised in that the tilting and anchoring mechanism (6) comprises a clamping screw (10), a male clamp (9*a*) and a female clamp (9*b*) made in two outer tubes (1).

5. The deployment device according to claim 1, characterised in that the outer tube (1) has at least one curvature.

6. The deployment device according to claim 1, characterised in that the extensible linking means consist of a plurality of inner tubes (2) joined to a plurality of outer tubes (1) by means of at least one anchoring system (5) and at least one tilting and anchoring mechanism (6).

7. The deployment device according to claim 1, characterised in that the extensible linking means comprise telescopic members (12).

8. The deployment device according to claim 1, characterised in that the extensible linking means comprise a deployable structure (15).

9. The deployment device according to claim 8, characterised in that the deployable structure (15) comprises an accordion-type structure.

10. The deployment device according to claim 1, characterised in that it includes a guiding system for an elongated and flexible element that is wound around the reel (7).

11. The deployment device according to claim 1, characterised in that it includes rolling means for its transport.

12. The deployment device according to claim 11, characterised in that the rolling means are remotely controlled.

13. The deployment device according to claim 1, characterised in that the support base (13) comprises two telescopic sections.

14. The deployment device according to claim 1, characterised in that it comprises a grip handle (17) attached in a sliding manner to one of the outer tubes (1).

15. The deployment device according to claim 14, characterised in that the grip handle (17) comprises a cable guiding mechanism (18).

* * * * *